US008872440B2

(12) United States Patent
Xi et al.

(10) Patent No.: US 8,872,440 B2
(45) Date of Patent: Oct. 28, 2014

(54) OPEN LED BYPASS CIRCUIT AND ASSOCIATED METHODS OF OPERATION

(75) Inventors: Frank Xi, Chengdu (CN); Zhengwei Zhang, Chengdu (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 632 days.

(21) Appl. No.: 13/231,880

(22) Filed: Sep. 13, 2011

(65) Prior Publication Data

US 2012/0062122 A1 Mar. 15, 2012

(30) Foreign Application Priority Data

Sep. 15, 2010 (CN) ..... 2010 1 0285957

(51) Int. Cl.
*H05B 37/02* (2006.01)
*H05B 33/08* (2006.01)

(52) U.S. Cl.
CPC ..... *H05B 33/0887* (2013.01)
USPC ..... 315/291; 315/307; 315/308

(58) Field of Classification Search
USPC ..... 315/209 R, 224, 247, 291, 307, 308, 315/312, 326
See application file for complete search history.

(56) References Cited

U.S. PATENT DOCUMENTS 7,800,316 B2 * 9/2010 Haug ..... 315/299

OTHER PUBLICATIONS

U.S. Appl. No. 13/051,437, filed Mar. 18, 2011.

* cited by examiner

*Primary Examiner* — Jimmy Vu
(74) *Attorney, Agent, or Firm* — Perkins Coie LLP

(57) ABSTRACT

The embodiments of the present circuit and method disclose a circuit to bypass a target circuit when an open status is detected. The present circuit may comprise a sample circuit, a monitoring circuit and a bypass circuit. The sample circuit may comprise a capacitor coupled to the target circuit. The monitoring circuit may be coupled to the capacitor and may have an output configured to generate an output signal selectively indicating the open status. The bypass circuit may comprise a switch, wherein the switch has a control terminal coupled to the output of the monitoring circuit and wherein the switch may be configured to be selectively turned ON to bypass the target circuit in accordance with the output of the monitoring circuit.

20 Claims, 8 Drawing Sheets

OPEN LED BYPASS CIRCUIT AND ASSOCIATED METHODS OF OPERATION

CROSS-REFERENCE TO RELATED APPLICATION

This application claims the benefit of CN application No. 201010285957.7, filed on Sep. 15, 2010, and incorporated herein by reference.

TECHNICAL FIELD

This invention relates generally to electrical circuits, and more particularly but not exclusively to light emitting diodes ("LEDs").

BACKGROUND

White LEDs ("WLEDs") have gained significant importance in the applications of general illumination market and display market. One example is the WLED street lamp application. In another example, traditional cold cathode fluorescent ("CCFL") backlight is being replaced by LED backlight in the liquid crystal display ("LCD") TV market. In such applications, a large number of LEDs can be coupled in series as a LED string to provide a desired brightness. The LED string can be driven by a voltage supply, for example, as high as 200V. Multiple strings are further configured to offer the desired backlight. The serially connected LEDs have a uniform current and have less power consumption than other configurations. However, if any LED in a string is damaged and becomes open, the whole string is off.

FIG. 1 schematically shows a traditional solution to bypass an open circuited LED by using a Zener diode. Several LEDs are coupled in series as a LED string and a power supply voltage $V_{SUP}$ (a differential voltage between SUP+ and SUP−) is used to provide power across the LED string. Zener diode triggered snapback transistor ZD is placed in parallel with each LED. Zener diode ZD has a breakdown voltage higher than a normal forward voltage $V_{A0}$ of the LED. Thereby in normal status of the LED, Zener diode ZD is open and does not consume power. If one LED in the string becomes open, supply voltage $V_{SUP}$ builds up across the open LED, and eventually breaks down the corresponding Zener diode ZD to conduct. Once the Zener diode ZD conducts, it triggers a snapback and clamps a forward voltage $V_A$ of the open LED at a clamping voltage $V_{CP}$ of Zener diode ZD.

However, the power consumption of Zener diode is not low and the Zener diode ZD cannot recover from snapbacks when the open circuited condition is removed, unless the entire LED string is rebooted.

SUMMARY

In one embodiment, a present circuit may be configured to bypass a target circuit when an open status is detected. The circuit may comprise a sample circuit, a monitoring circuit and a bypass circuit. The sample circuit may comprise a capacitor coupled to the target circuit. The monitoring circuit may be coupled to the capacitor and may have an output configured to generate an output signal selectively indicating the open status. The bypass circuit may comprise a switch, wherein the switch may have a control terminal coupled to the output of the monitoring circuit and wherein the switch may be configured to be selectively turned ON to bypass the target circuit in accordance with the output of the monitoring circuit.

The use of the same reference label in different drawings indicates the same or like components.

DETAILED DESCRIPTION

In the present disclosure, numerous specific details are provided, such as examples of circuits, components, and methods, to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

Several embodiments of the present invention are described below with reference to bypass circuits for serially coupled LEDs and associated method of operation. As used hereinafter, the term "LED" encompasses LEDs, laser diodes ("LDs"), polymer LEDs ("PLEDs"), and/or other suitable light emitting diodes. The term "couple" generally refers to multiple ways including a direct connection with an electrical conductor and an indirect connection through intermediate diodes, resistors, capacitors, and/or other intermediaries. The term "forward voltage" of a LED generally means a differential voltage across the LED. The term "voltage drop" generally means a differential voltage across a switch, e.g., a differential voltage across an anode and a cathode of a diode, a differential voltage across a drain and a source of a Field Effect Transistor (FET), or a differential voltage across a collector and an emitter of a Bipolar Junction Transistor (BJT).

Figure 1:
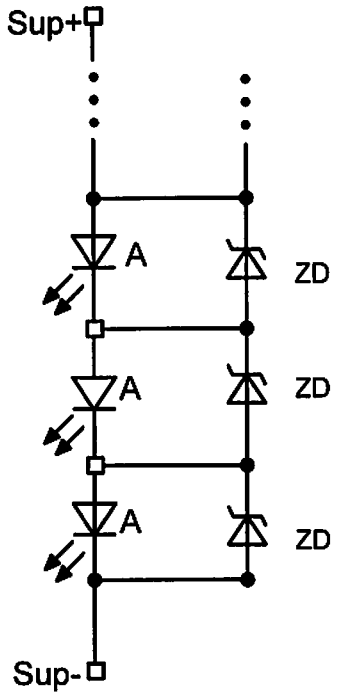
FIG. 1 schematically shows a traditional solution to bypass an open circuited LED by using a Zener diode.
Figure 2:
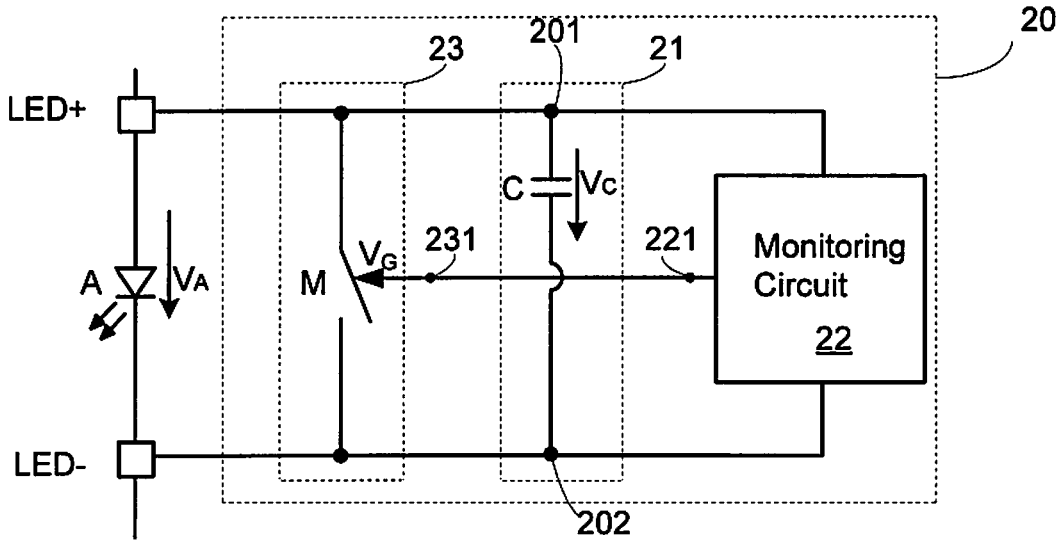
FIG. 2 schematically illustrates a circuit comprising a sample circuit, a monitoring circuit and a bypass circuit in accordance with an embodiment of the present invention.

FIG. 2 schematically shows a circuit 20 in accordance with an embodiment of the present invention. Circuit 20 is coupled in parallel with an LED A and is configured to bypass the LED A when an open status is detected. Even though only certain components are shown in FIG. 2, in other embodiments, circuit 20 can further include switches, diodes, transistors, and/or other suitable components in addition to or in lieu of the components shown in FIG. 2. In certain embodiments, the LED A is serially connected to other LEDs (not shown) in a string of LEDs supplied by a power supply voltage $V_{SUP}$. Though only one LED is shown in FIG. 2 as a target circuit to be bypassed, in other embodiments, the target circuit may include any number of LEDs, electroluminescent devices, and/or other illumination devices configured as a single device, a string of devices, an array of devices, and/or other suitable arrangements. In other embodiments, the LED A may be connected to other LEDs in other suitable arrangements.

As shown in FIG. 2, circuit 20 comprises a sample circuit 21, a monitoring circuit 22 and a bypass circuit 23. Sample circuit 21 is coupled to LED A and is configured to sample a forward voltage $V_A$ ($V_{LED+}$-$V_{LED-}$) of LED A. Sample circuit 21 comprises a capacitor C. The capacitor C has a first terminal 201 coupled to an anode (i.e., LED+) of LED A and has a second terminal 202 coupled to a cathode (i.e., LED−) of LED A. If bypass circuit 23 is deactivated and the forward voltage $V_A$ of LED A is higher than a capacitor voltage $V_C$ (i.e., a differential voltage across capacitor C), then capacitor C is charged by the forward voltage $V_A$. If bypass circuit 23 is activated and the forward voltage $V_A$ is less than the capacitor voltage $V_C$, then capacitor C is discharged. In one embodiment, capacitor C is discharged by a quiescent current and/or by a bias current of monitoring circuit 22. In other embodiments, capacitor C is discharged by other devices and/or by other components. Monitoring circuit 22 is coupled to capacitor C and is configured to generate an output signal $V_G$ indicating whether an open status of LED A exists. Bypass circuit 23 has a control input 231 coupled to output 221 of monitoring circuit 22. Bypass circuit 23 is configured to be selectively activated to bypass the LED A in accordance with the control input indicating the open status. Bypass circuit 23 comprises a switch M coupled to LED A in parallel. Switch M comprises a control terminal coupled to control input 231 of bypass circuit 23, i.e., coupled to output 221 of monitoring circuit 22. $V_G$ is the signal at the control terminal of switch M. Switch M is configured to be selectively turned ON to bypass the LED A in accordance with signal $V_G$. Switch M is configured to be turned ON when output signal $V_G$ of monitoring circuit 22 indicates the open status. When switch M is turned ON, LED A is bypassed with current flowing through switch M, and the other LEDs (not shown) in a string continue to produce light. In one embodiment, switch M is a metal oxide semiconductor field effect transistor ("MOSFET"). The MOSFET can be either N type or P type. Other types of switches such as bipolar junction transistor ("BJT") or junction field effect transistor ("JFET") can also be adopted as switch M of bypass circuit 23. Voltage drop $V_{ON}$ across switch M at its ON state is substantially lower than the clamping voltage $V_{CP}$ of Zener diode ZD, and the power consumption accordingly is substantially lower when LED A is bypassed. In one example, switch M with a MOSFET may have a voltage drop $V_{ON}$ of about 50 mV, while the clamping voltage $V_{CP}$ may be 7V.

Figure 3:
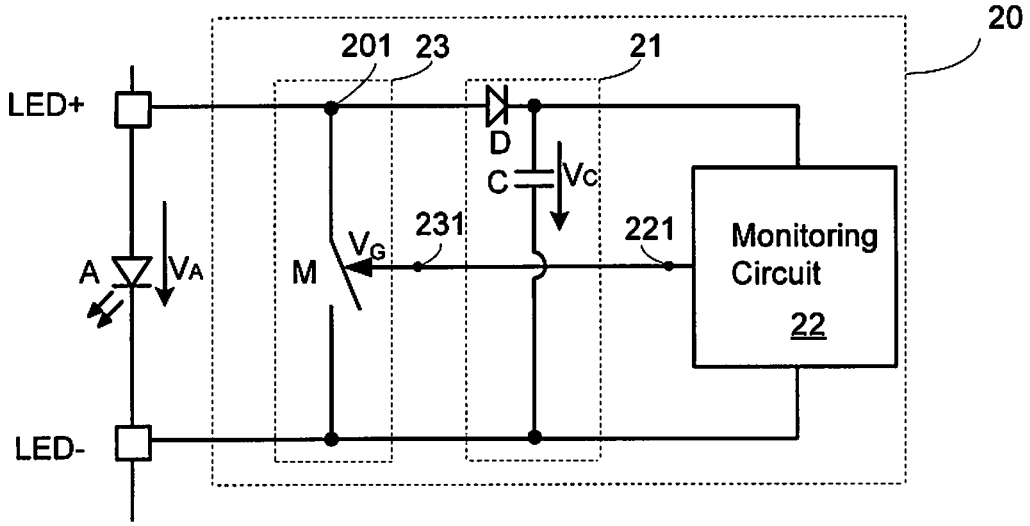
FIG. 3 schematically illustrates a circuit further comprising a diode in the sample circuit in accordance with an embodiment of the present invention.

FIG. 3 schematically illustrates a circuit further comprising a diode in the sample circuit in accordance with an embodiment of the present invention. The first terminal of capacitor C is coupled to the anode of LED A by way of a diode D. An anode of diode D is connected to the anode of LED A and a cathode of diode D is connected to the first terminal 201 of capacitor C.

In one embodiment, monitoring circuit 22 is configured to determine the status of LED A by monitoring the voltage Vc across capacitor C (capacitor voltage $V_C$). Monitoring circuit 22 may generate an activating signal at output 221 indicating an open status when capacitor voltage $V_C$ is higher than a threshold voltage. Otherwise, monitoring circuit 22 may generate a deactivating signal at output 221 indicating a normal status when capacitor voltage $V_C$ is less than the threshold voltage.

Continuing with FIG. 2 and FIG. 3, when an LED A fails and/or is otherwise in an open status, a supply voltage $V_{SUP}$ supplying the entire LED string builds up on the open LED A, and its forward voltage $V_A$ rises. Capacitor voltage $V_C$ rises accordingly. In one embodiment, when with a diode D connected between capacitor C and the anode of LED A, capacitor voltage $V_C$ rises up to $V_A$-$V_{DROP}$, wherein $V_{DROP}$ is a voltage drop across diode D. And then monitoring circuit 22 may be configured to generate an activating signal at output 221, and switch M may be turned ON to bypass the damaged LED A. In one embodiment, if capacitor voltage $V_C$ is higher than the threshold voltage, monitoring circuit 22 is configured to generate an activating signal at output 221 indicating an open status, switch M may be turned ON and the current may flow through switch M and through the remaining normal LEDs in the LED string. During normal status of LED A, if capacitor voltage $V_C$ is kept lower than a threshold voltage, switch M is kept OFF and circuit 20 would not interfere with the normal operation of LED A.

During open status of LED A, switch M may be controlled to be periodically turned OFF to check if the LED A heals back to normal status. In one embodiment, when LED A is bypassed, capacitor C is discharged to keep the capacitor voltage $V_C$ larger than the threshold voltage and hold switch M ON for a period of time. When capacitor voltage $V_C$ is decreased to be less than the threshold voltage, monitoring circuit 22 is configured to generate a deactivating output 221 and switch M would be turned OFF accordingly. If the LED A heals back to normal status, and its forward voltage $V_A$ is back to the normal forward voltage $V_{A0}$ which is substantially less than the threshold voltage, then capacitor voltage $V_C$ keeps less than the threshold voltage and switch M keeps OFF correspondingly. In contrast, if the LED A is still in open status, its forward voltage $V_A$ and capacitor voltage $V_C$ rise again. When capacitor voltage $V_C$ increases to be higher than the threshold voltage, monitoring circuit 22 generates an activating output 221 indicating the open status and switch M is turned ON to bypass the LED A again.

Figure 4:
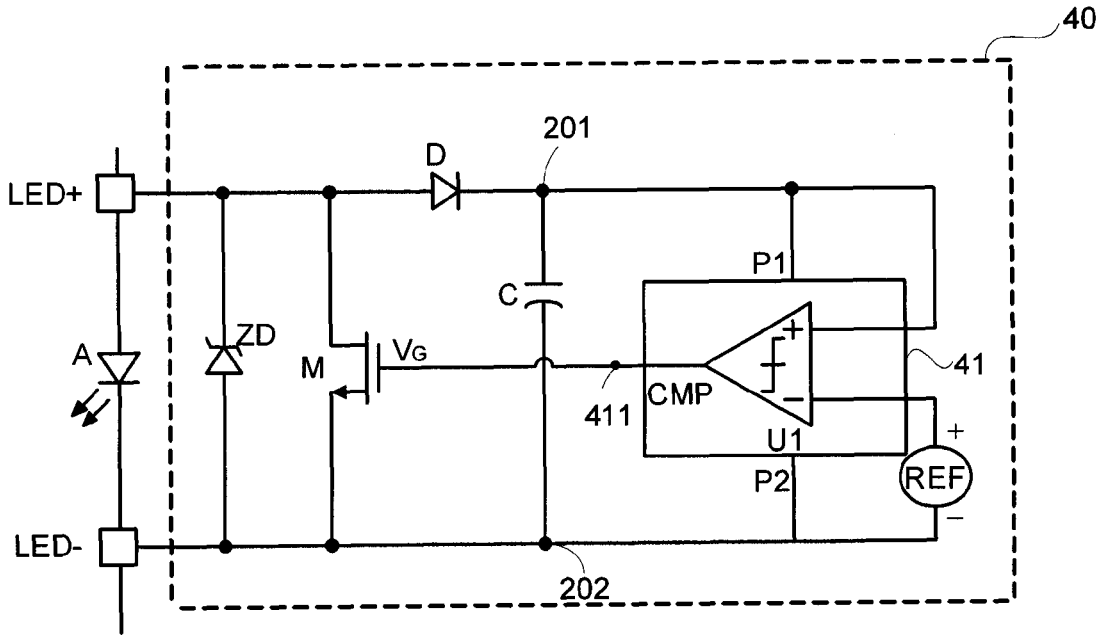
FIG. 4 schematically illustrates a circuit further comprising a comparator in the monitoring circuit in accordance with an embodiment of the present invention.

FIG. 4 schematically illustrates a circuit 40 further comprising a comparator U1 in monitoring circuit 41 and a voltage source REF in accordance with an embodiment of the present invention. Voltage $V_{REF}$ is a differential voltage across voltage source REF and is served as the threshold voltage compared with capacitor voltage $V_C$ to judge whether the LED A is in open status.

Comparator U1 is configured to compare capacitor voltage $V_C$ with threshold voltage $V_{REF}$. Comparator U1 has a non-inverting input terminal coupled to capacitor voltage $V_C$, an inverting input terminal coupled to threshold voltage $V_{REF}$, and an output CMP coupled to switch M as output 411 of monitoring circuit 41. In one embodiment, the threshold voltage $V_{REF}$ is generated by circuit 40 and voltage $V_{REF}$ is substantially higher than the normal forward voltage $V_{A0}$ of LED A. In another embodiment, the threshold voltage $V_{REF}$ is from external and can be modulated.

Monitoring circuit 41 may further comprise two power supply input terminals. The first power supply input P1 is coupled to the first terminal 201 of capacitor C and the second power supply input P2 is coupled to the second terminal 202 of capacitor C. In this configuration, capacitor C may be discharged by a bias current between the first power supply input P1 and the second power supply input P2 partially. And monitoring circuit 51 is powered by the voltage across capacitor C. In other embodiments, monitoring circuit 41 is powered by other voltage source.

Circuit 40 may further comprise a Zener diode ZD coupled to LED A in parallel. In one embodiment, clamping voltage $V_{CP}$ of Zener diode ZD is substantially higher than normal forward voltage $V_{A0}$ of LED A. However, when the LED A fails, its forward voltage $V_A$ rises until the Zener diode ZD snapbacks and clamps the forward voltage $V_A$ to its clamping voltage $V_{CP}$. The threshold voltage $V_{REF}$ is set to be higher than the normal forward voltage $V_{A0}$ of LED A, and is set to be lower than the clamping voltage $V_{CP}$ of Zener diode ZD. In one example, the clamping voltage $V_{CP}$ of Zener diode ZD is about 7V, the normal forward voltage $V_{AD}$ of LED A is about 4V, and the threshold voltage $V_{REF}$ is about 5V. In other embodiments without Zener diode ZD, forward voltage $V_A$ of LED A rises to supply voltage $V_{SUP}$ when the LED A fails.

Switch M is coupled in parallel to LED A. In one embodiment shown in FIG. 4, switch M is an N type MOSFET. The drain of switch M is coupled to the anode of LED A, the source of switch M is coupled to the cathode of LED A, and the gate of switch M is coupled to output 411 of monitoring circuit 41. Thus, when gate signal $V_G$ is HIGH, switch M is turned ON, the LED A is bypassed with current flowing through switch M, and the other LEDs in a string (not shown) continue to work and produce back light. In one embodiment, switch M is a lateral double diffused MOSFET ("LDMOS") integrated with monitoring circuit 41 on a single semiconductor substrate. Though N type MOSFET is featured in this embodiment, P type MOSFET or other types of switch such as bipolar junction transistor ("BJT") may also be adopted as a bypass switch.

Figure 5:
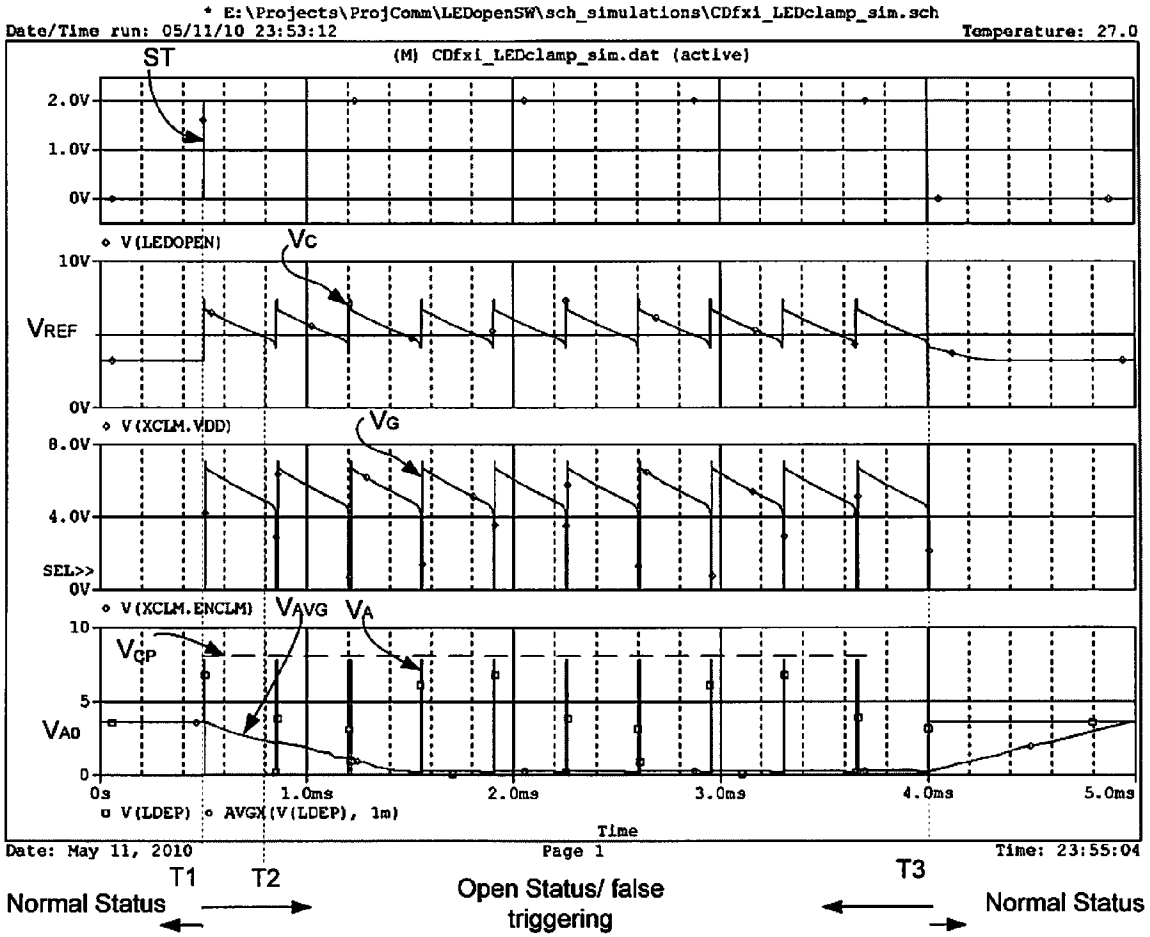
FIG. 5 shows simulated waveforms of the circuit of FIG. 4 in accordance with an embodiment of the present invention.

FIG. 5 shows example waveforms of the circuit of FIG. 4 in a simulation in accordance with embodiments of the present invention. The first waveform signal ST indicates the status of LED A. LOW ST indicates that the LED A is in normal status, and HIGH ST indicates that the LED A is in open status or has false triggering. The second waveform shows capacitor voltage $V_C$. The third waveform is control signal $V_G$ of switch M. And the last waveform shows forward voltage $V_A$ of LED A. Average voltage $V_{AVG}$ of the forward voltage $V_A$ is also shown in the last waveform.

Before time T1, LED A operates in normal status (ST LOW) and forward voltage $V_A$ of LED A is at its normal level $V_{A0}$. Capacitor voltage $V_C$ is $V_{A0}$-$V_{DROP}$, which is lower than threshold voltage $V_{REF}$. Comparator U1 compares capacitor voltage $V_C$ with threshold voltage $V_{REF}$ and outputs LOW CMP signal at output 411 indicating normal status of LED A. Control signal $V_G$ remains in LOW level and switch M keeps OFF. At time T1, LED A fails and shifts to open status, i.e., ST is HIGH. Power supply voltage of the LED string builds up across the failed LED A, then forward voltage $V_A$ of LED A rises and is clamped by Zener diode ZD at clamping voltage $V_{CP}$. Capacitor voltage $V_C$ is charged up to $V_{CP}$-$V_{DROP}$, which is higher than threshold voltage $V_{REF}$. Comparator U1 compares capacitor voltage $V_C$ with threshold voltage $V_{REF}$ and outputs HIGH CMP signal at output 411 indicating an open status after a short intrinsic delay time. Control signal $V_G$ becomes HIGH accordingly and switch M is turned ON to bypass the LED A. Other conditions such as a voltage spike can also falsely trigger turning ON switch M.

Once switch M is turned ON after time T1, forward voltage $V_A$ of LED A drops to the voltage drop $V_{ON}$ across switch M, e.g., 200 mV. The diode D is under a reverse voltage and there is little or no current flows from the first terminal of capacitor C to the anode of LED A. Capacitor C may be discharged by a bias current between the two power supply input of comparator U1. Capacitor voltage $V_C$ is decreased slowly to hold control signal $V_G$ HIGH for a period of time. At time T2, capacitor voltage $V_C$ is decreased to be lower than the threshold voltage $V_{REF}$, then comparator U1 outputs LOW CMP signal and control signal $V_G$ becomes LOW to turn OFF switch M. Once switch M is turned OFF, forward voltage $V_A$ of LED A rises again and another cycle is started per the open status still exists. In this way, capacitor C is discharged and switch M is turned OFF periodically to check if the failed LED A is healed back to normal. If LED A remains in open status, this operation will repeat by itself. Control signal $V_G$ periodically transits between HIGH and LOW, and forward voltage $V_A$ of LED A periodically transits between the clamping voltage $V_{CP}$ and voltage drop $V_{ON}$. The time period that positive control signal $V_G$ lasts is increased when the capacitor C is discharged by a smaller current. As shown in FIG. 5, when capacitor C is discharged far slower than is charged, the duty cycle of control signal $V_G$ is high and low average voltage $V_{AVG}$ can be achieved.

If healing condition is detected, i.e., ST is LOW, switch M is turned OFF to allow the healed LED A to operate normally. Referring to time T3, the LED A shifts to healing condition or the condition that false triggering situation is eliminated. When switch M is turned OFF at the falling edge of control signal $V_G$, forward voltage $V_A$ of LED A would rise to its normal forward voltage $V_{A0}$. Capacitor voltage $V_C$ keeps less than threshold voltage $V_{REF}$ and then switch M would remain in OFF state. Thus, the LED A recovers to normal status and is not affected by circuit 40.

Figure 6:
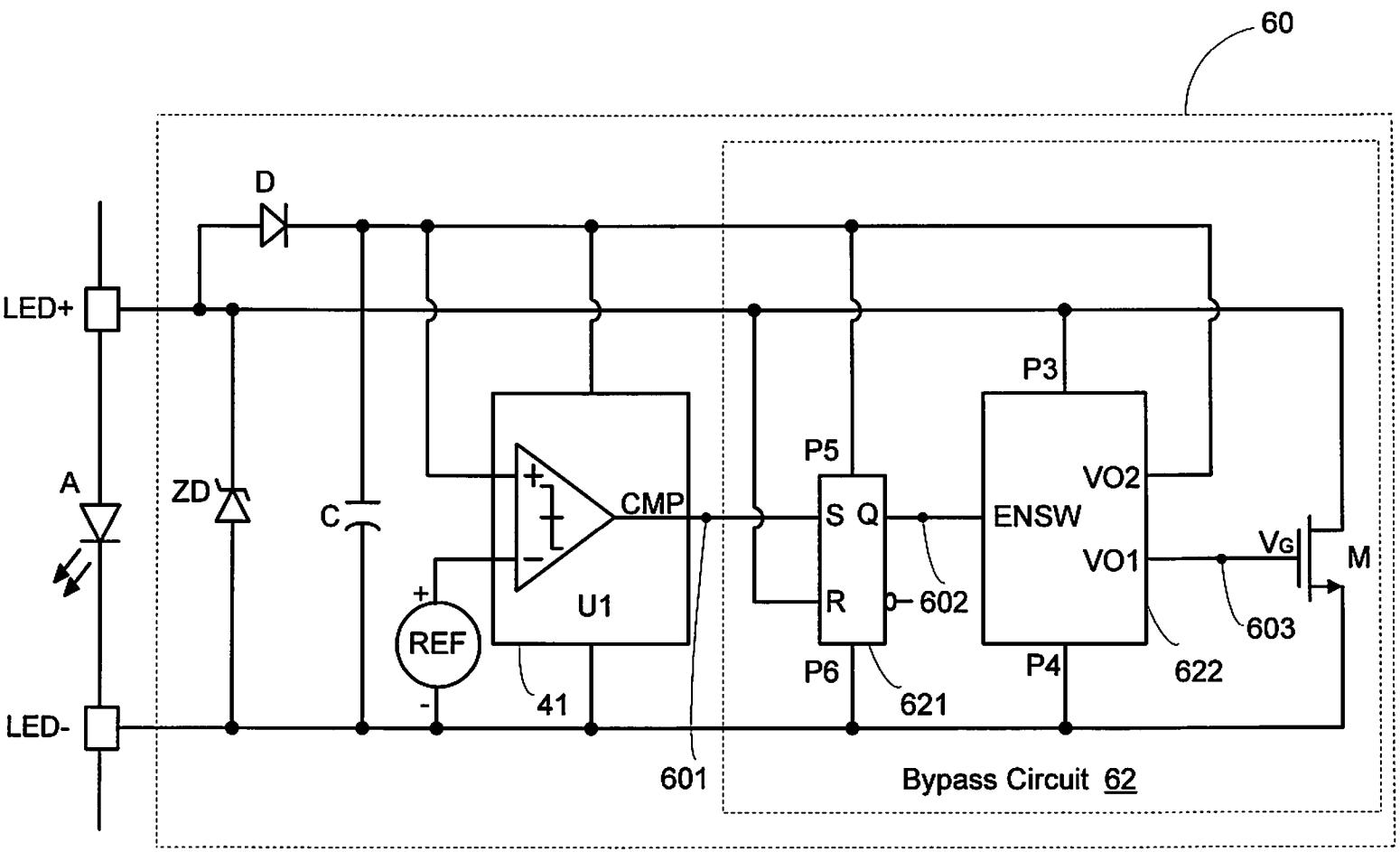
FIG. 6 schematically illustrates a circuit wherein the bypass circuit further comprises a latch and a charge pump in accordance with an embodiment of the present invention.

FIG. 6 schematically illustrates a circuit 60 wherein bypass circuit 62 further comprises a latch 621 and a charge pump 622 in accordance with an embodiment of the present invention. Circuit 60 is the same as circuit 40 except bypass circuit 62. Only bypass circuit 62 is described below for simplicity and clarity. Bypass circuit 62 comprises a latch 621, a charge pump 622 and a switch M. Latch 621 comprises a set terminal (S), a reset terminal (R) and an output (Q). The set terminal of latch 621 is coupled to output of the monitoring circuit at node 601. The reset terminal of latch 621 is coupled to the anode of LED A. Charge pump 622 comprises an input ENSW coupled to output Q of latch 621 at node 602, and comprises a first output VO1 connected to control terminal of switch M at node 603.

An activating signal at the set terminal of latch 621 is used to produce HIGH output, i.e., Q="1", and an activating signal at the reset terminal of latch 621 is used to produce LOW output, i.e., Q="0". Output Q of latch 621 may change as soon as signal at the set terminal and/or at the reset terminal changed. The set terminal has higher priority than the reset terminal for latch 621, and the truth table is shown below.

| | | | | |
|---|---|---|---|---|
| S | "1" | "0" | "1" | "0" |
| R | "0" | "1" | "1" | "0" |
| Q | "1" | "0" | "1" | No change |

When S="1", then Q="1"; when S="0" and R="1" then Q="0"; when S="1" and R="1" then Q="1", otherwise there is no change on Q. As a result, latch 621 produce HIGH output Q when the output of the monitoring circuit is HIGH, i.e., signal at output CMP of comparator U1 is HIGH. Latch 621 produce LOW output Q, when signal at output CMP of comparator U1 is LOW and forward voltage $V_A$ of LED A is HIGH. Normal forward voltage $V_{A0}$ of LED A is in logic HIGH. Latch 621 has a first power supply input P5 coupled to the first terminal of capacitor C and has a second power supply input P6 coupled to the second terminal of capacitor C. Thus latch 621 is powered by capacitor C and discharge capacitor C partially by a bias current between power supply inputs P5 and P6. In other embodiments, latch 621 may be powered by other source such as external voltage source.

In the example of FIG. 6, charge pump 622 is enabled to output power at output VO1 and switch M is turned ON when signal at input ENSW is activating. Charge pump 622 is disabled and switch M is turned OFF when signal at input ENSW is deactivating. Charge pump 622 further comprises a second output VO2 coupled to the first terminal of capacitor C. The second output VO2 may be configured to maintain capacitor voltage $V_C$ above a minimum voltage $V_{C0}$ when charge pump 622 is enabled. In one embodiment, $V_{C0}$ is the voltage at output VO2 of charge pump 622. In one embodiment, the amplitude of voltage at output VO2 equals the amplitude of voltage at output V01. Charge pump 622 has a first power supply input P3 coupled to the anode of LED A, and has a second power supply input P4 coupled to the cathode of LED A. In other embodiments, charge pump 622 may be powered by other source such as external voltage source. Charge pump 622 may be replaced by other circuit such as voltage regulator which could be enabled to generate power.

Continuing with FIG. 6, when an LED A fails and/or is otherwise in an open status, forward voltage $V_A$ of LED A rises and is clamped by the Zenor diode ZD at the clamping voltage $V_{CP}$, and capacitor voltage $V_C$ is charged up to $V_{CP}$-$V_{DROP}$. When capacitor voltage $V_C$ is larger than threshold voltage $V_{REF}$ (i.e., $V_C$>$V_{REF}$), comparator U1 outputs HIGH signal at output CMP, latch 621 is set to produce HIGH output Q, charge pump 622 is enabled to generate HIGH control signal $V_G$ to turn ON switch M, and then the failed LED A is bypassed by switch M. Once switch M is turned ON, forward voltage $V_A$ of LED A is decreased to voltage drop $V_{ON}$ across switch M.

It is noted that the logics of "HIGH" or "LOW" for the logic signals may be in alternative levels since different logic levels may lead to a same result. For example, when forward voltage $V_A$ is higher than threshold voltage $V_{REF}$, switch M is turned ON no matter the voltage at output CMP of comparator U1 or control signal $V_G$ is in logic "HIGH" or logic "LOW".

Figure 7:
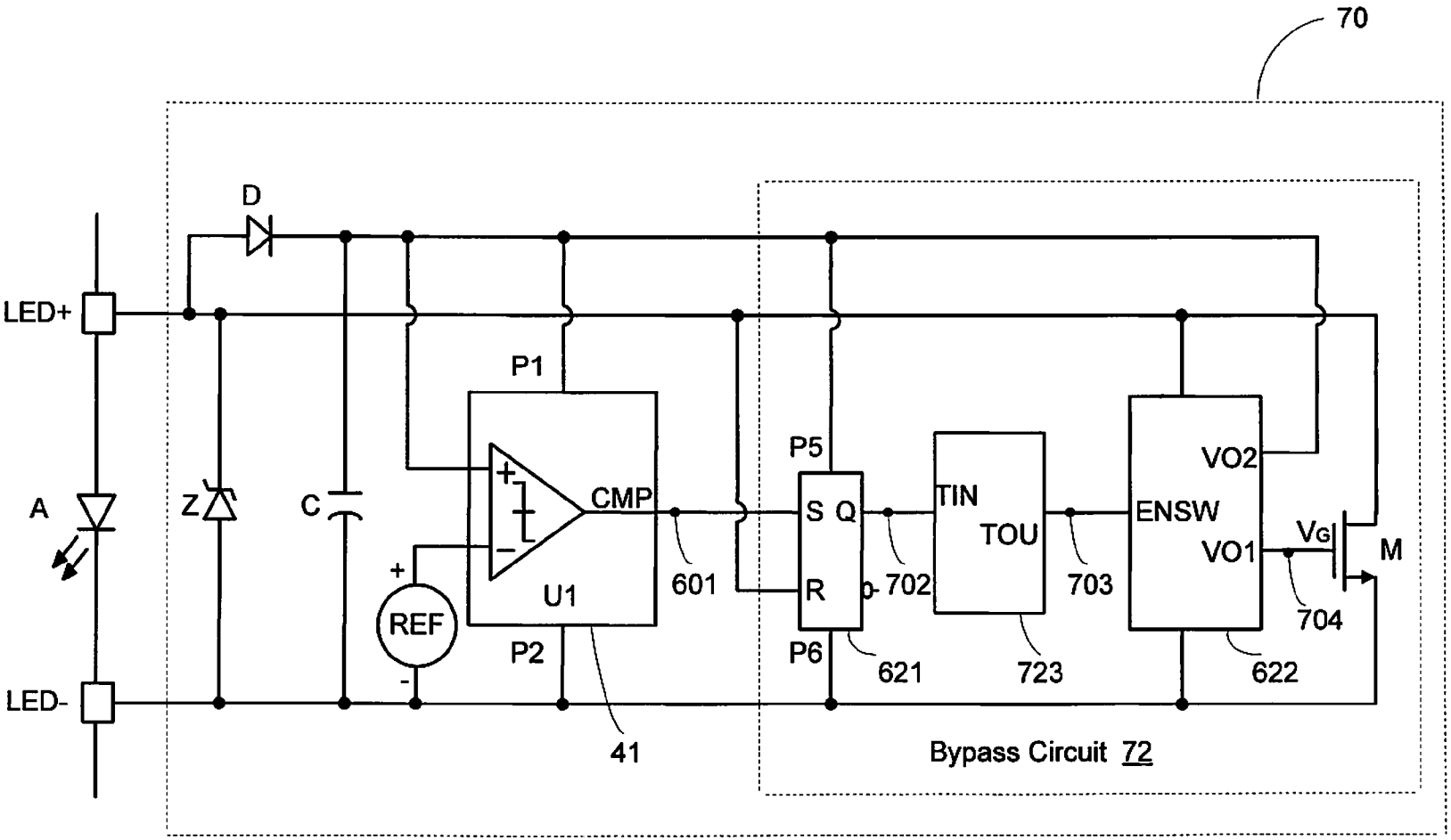
FIG. 7 schematically illustrates a circuit wherein the bypass circuit further comprises a pulse generator in accordance with an embodiment of the present invention.

FIG. 7 schematically illustrates a circuit 70 wherein bypass circuit 72 further comprises a pulse generator 723 in accordance with an embodiment of the present invention. Switch M may be forced OFF periodically by pulse generator 723 to check forward voltage $V_A$ of LED A and refresh the output Q of latch 621. Pulse generator 723 is connected between latch 621 and charge pump 622. Pulse generator 723 comprises an input TIN connected to output Q of latch 621 at node 702 and an output TOU connected to input ENSW of charge pump 622 at node 703. Signal at output TOU is deactivating when signal at input TIN is deactivating. Signal at output TOU is activating when signal at input TIN becomes activating and the signal at output TOU is forced deactivating after a time period expires. In one embodiment, a maximum time period for signal at output TOU maintaining activating is predetermined by pulse generator 723. Thus, signal at output TOU is activated for a time period and is deactivated after the expiration of a maximum time period. Charge pump 622 is enabled to output power (e.g., voltage) at output VO1 and VO2 when receives activating signal at node 703, and is disabled when receives deactivating signal at node 703. As a result, switch M is forced OFF periodically to check the forward voltage $V_A$ and to judge if the LED A heals back to normal status. If the LED A remains in open status, when switch M is turned OFF, forward voltage $V_A$ of LED A rises and is clamped by the Zenor diode ZD at the clamping voltage $V_{CP}$ again, capacitor voltage $V_C$ is charged up to $V_{CP}$-$V_{DROP}$, which is higher than threshold voltage $V_{REF}$, and then switch M is turn ON again and repeats this periodical function. When the LED A heals back to normal status, when switch M is turned OFF, forward voltage $V_A$ of LED A rises up to its normal forward voltage $V_{A0}$, and capacitor voltage $V_C$ is charged to $V_{A0}$-$V_{DROP}$, which is less than threshold voltage $V_{REF}$. Latch 621 is reset to output LOW Q at node 702 and charge pump 622 is disabled, control signal $V_G$ maintains LOW, switch M is kept OFF and circuit 70 will not interfere with the normal operation of LED A.

Figure 8:
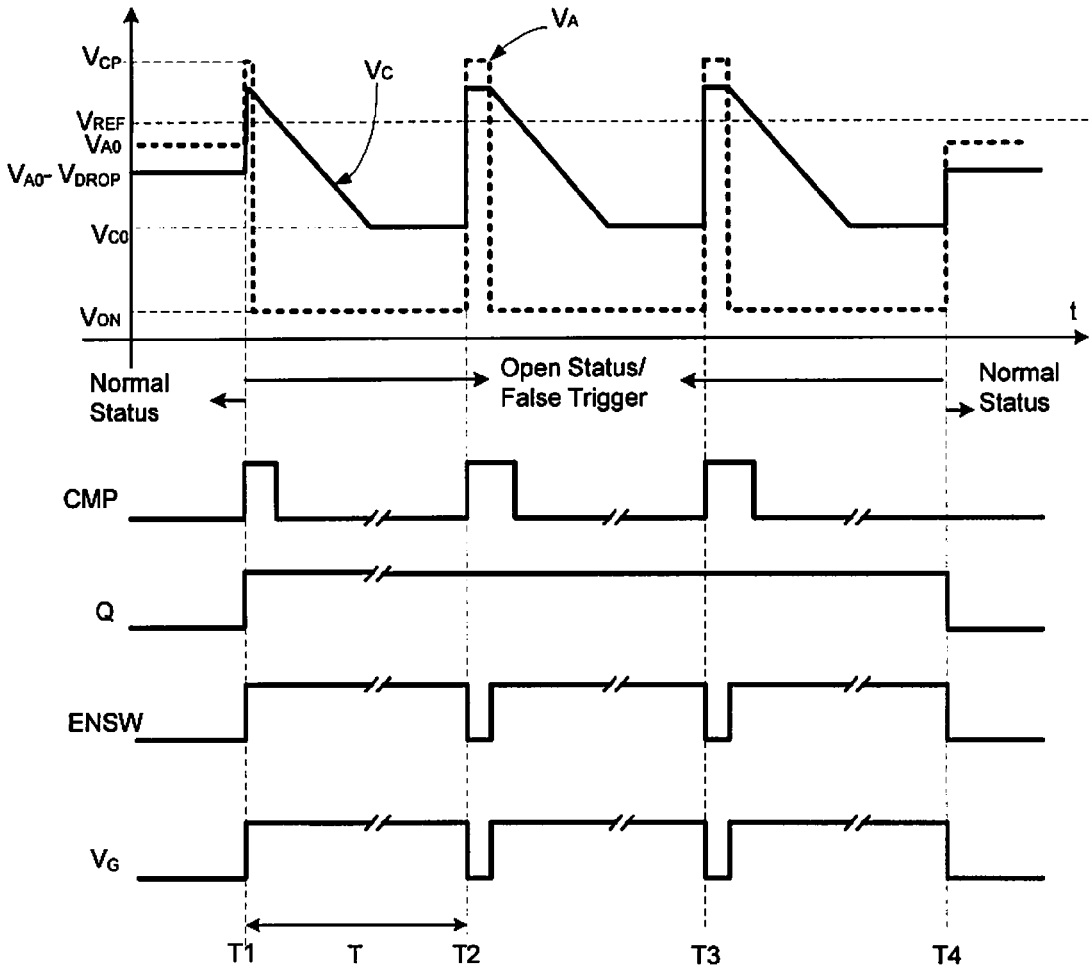
FIG. 8 shows example waveforms of the circuit of FIG. 7 in accordance with an embodiment of the present invention.

FIG. 8 shows example waveforms of the circuit of FIG. 7 in accordance with embodiments of the present invention. The first waveform shows forward voltage $V_A$ of LED A and capacitor voltage $V_C$. The second waveform shows output signal of comparator U1 at output CMP. The third waveform is output signal of latch 621 at the Q output. The fourth waveform is input signal of charge pump 622 at input ENSW. And the last waveform is the control signal $V_G$ of switch M. The signals at CMP, Q, ENSW and the control signal $V_G$ only show a logic level, i.e., in logic HIGH or logic LOW for simplicity and clarity. It is noted that the logics of "HIGH" or "LOW" for the logic signals may be in alternative levels since different logic levels may lead to a same result.

Before time T1, LED A operates in normal status, forward voltage $V_A$ is at its normal level $V_{A0}$. Capacitor voltage $V_C$ is $V_{A0}$-$V_{DROP}$, which is lower than threshold voltage $V_{REF}$. Comparator U1 compares capacitor voltage $V_C$ with threshold voltage $V_{REF}$ and outputs LOW signal at output CMP. Signal at the Q output of latch 621, signal at input ENSW of charge pump 622, and control signal $V_G$ of switch M remain LOW. Switch M is kept OFF.

At time T1, LED A fails and shifts from normal status to open status. Power supply voltage of the LED string builds up across the failed LED A, forward voltage $V_A$ of LED A rises and is clamped by the Zenor diode ZD at the clamping voltage $V_{CP}$, capacitor voltage $V_C$ is charged up to $V_{CP}$-$V_{DROP}$, which is higher than threshold voltage $V_{REF}$. Comparator U1 compares capacitor voltage $V_C$ with threshold voltage $V_{REF}$ and outputs HIGH signal at output CMP indicating an open status. Latch 621 is set to generate HIGH Q output. Once receives a HIGH input signal at input TIN, pulse generator 723 outputs HIGH at node 703 to enable charge pump 622. Charge pump 622 is enabled to generate outputs at both VO1 and VO2. As a result, the control signal $V_G$ is HIGH and switch M is turned ON to bypass the failed LED A. Once switch M is turned ON, forward voltage $V_A$ of LED A decreased to voltage drop $V_{ON}$ across switch M. Capacitor C is then discharged by the bias current of latch 621 and/or by the bias current of charge pump 622. The capacitor voltage $V_C$ is decreased to $V_{C0}$ and is maintained at $V_{C0}$. $V_{C0}$ is the voltage at output VO1 of charge pump 622. In the example of FIG. 7, charge pump 622 is powered by forward voltage $V_A$ of LED A. The amplitude of voltage $V_A$ equals the amplitude of voltage drop $V_{ON}$ across switch M. And the amplitude of $V_{C0}$ may be determined by voltage drop $V_{ON}$ across switch M and charge pump 622:

$$V_{C0}=K*V_{ON} \quad \text{(EQ. 1)}$$

Wherein K is charge pump ratio from input voltage (i.e., $V_{ON}$) to output voltage (i.e., $V_{C0}$). In one embodiment, the charge pump ratio K is 6, i.e. $V_{C0}$=$V_{ON}$. Capacitor C may have enough charge to power the monitoring circuit 41 and/or the latch 621, thus additional power may be not needed, and the power consumption of circuit 70 may be lower.

After time period (T2-T1) for HIGH signal at ENSW, pulse generator 723 is configured to output LOW at ENSW. Control signal $V_G$ is pulled down at time T2 to turn OFF switch M. If open status still exists, when switch M is turned off, forward voltage $V_A$ of LED A and the capacitor voltage $V_C$ are increased again. When capacitor voltage $V_C$ increased up to threshold voltage $V_{REF}$, comparator U1 output HIGH signal at CMP. Thereby switch M is turned ON again. During time period T1 to T4, LED A remains in open status, and the operation repeats by itself. At each cycle, switch M is turned OFF after a predetermined maximum time period for HIGH signal at ENSW, referring t1, t2, t3 and t4. The duty cycle of switch M is determined by duty cycle of the signal at ENSW. In one embodiment, the duty cycle of the signal at ENSW is 90%.

After time period (T4-T3) for HIGH signal at ENSW, pulse generator 723 is configured to output LOW at ENSW. Control signal $V_G$ is pulled down at time T4 to turn OFF switch M. If LED A shifts to healing condition or the false triggering situation is eliminated, when switch M is turned OFF at the falling edge of control signal $V_G$ at time T4, forward voltage $V_A$ of LED A rises up to its normal forward voltage $V_{A0}$, capacitor voltage $V_C$ is charged up to $V_{A0}$-$V_{DROP}$, which is lower than threshold voltage $V_{REF}$. Comparator U1 outputs LOW signal at CMP and Latch 621 is reset to output LOW Q. Signal at ENSW and control signal $V_G$ is LOW. Switch M is kept OFF after time T4.

Figure 9:
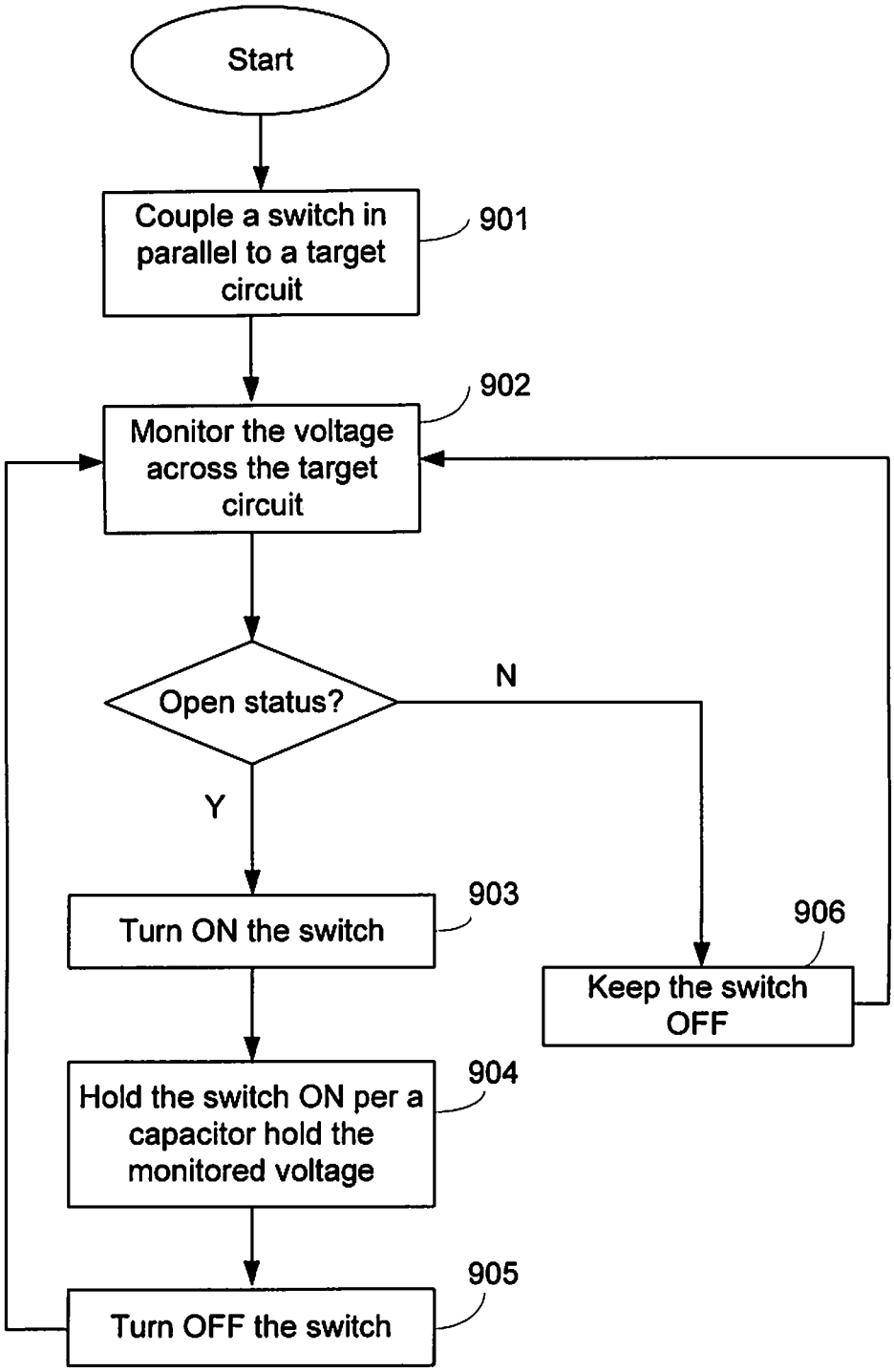
FIG. 9 is a block diagram illustrating a method of bypassing an open target circuit in accordance with one embodiment of the present invention.

FIG. 9 is a block diagram illustrating a method of bypassing an open status target circuit in accordance with embodiments of the present technology. At stage 901, a switch is coupled in parallel to a target circuit. At stage 902, a forward voltage of the target circuit is monitored to determine whether the target circuit is in an open status. In one embodiment, the open status is monitored by a capacitor coupled to the target circuit in parallel, if the capacitor voltage is higher than a threshold voltage, the target circuit is judged as in open status. If the target circuit is judged in normal status, the switch is kept OFF at stage 906. If the target circuit fails and an open status is detected, the switch is turned ON to bypass the target circuit at stage 903. The failed target circuit is periodically checked to see if it is healed back to normal status. At stage 904, the switch is maintained ON for a period of time by using the capacitor to hold the monitored voltage, and at stage 905, the switch is turned OFF to check if healing condition is occurred. In one embodiment, the capacitor is discharged, and the switch is turned OFF when the capacitor voltage is decreased to be less than threshold voltage. In one embodiment, the duty cycle of the switch is related with the discharged rate of the capacitor. For example, the duty cycle of the switch is larger when the capacitor is discharged slower. In another embodiment, the switch is forced OFF periodically after a maximum period of time during which the switch is kept ON. The duty cycle of the switch is related with the maximum period of time. For example, the duty cycle of the switch is larger when the switch is kept ON with longer maximum time period.

Once turning OFF the switch at stage 905, the process reverts to stage 902 to check if the target circuit is healed. At stage 902, if healing condition is detected, the switch is kept OFF at stage 906, and the healed target circuit would operate normally. If the target circuit is still in open status, the switch is turned ON at stage 903 to start another cycle.

In one embodiment, the target circuit is a LED among a plurality of LEDs coupled in series. In other embodiments, the target circuit may include any number of LEDs, electroluminescent devices, and/or other illumination devices configured as a single device, a string of devices, an array of devices, and/or other suitable arrangements.

The above description and discussion about specific embodiments of the present technology is for purposes of illustration. However, one with ordinary skill in the relevant art should know that the invention is not limited by the specific examples disclosed herein. Variations and modifications can be made on the apparatus, methods and technical design described above. Accordingly, the invention should be viewed as limited solely by the scope and spirit of the appended claims.

We claim:

1. A circuit, comprising:

a sample circuit, coupled to a target circuit, the sample circuit comprising a capacitor, wherein the capacitor has a first terminal coupled to an anode of the target circuit and wherein the capacitor has a second terminal coupled to a cathode of the target circuit;

a monitoring circuit, coupled to the capacitor and the monitoring circuit having an output configured to generate an output signal selectively indicating an open status of the target circuit; and a bypass circuit, comprising a switch, wherein the switch comprises a control terminal coupled to the output of the monitoring circuit, and wherein the switch is configured to be selectively activated to bypass the target circuit in accordance with the output of the monitoring circuit.

2. The circuit of claim 1, wherein the sample circuit further comprises a diode having an anode connected to the anode of the target circuit and having a cathode connected to the first terminal of the capacitor.

3. The circuit of claim 1, wherein the target circuit is a light emitting diode (LED) among a plurality of LEDs coupled in series.

4. The circuit of claim 1, wherein the monitoring circuit comprises a comparator configured to compare a capacitor voltage with a threshold voltage, and wherein the monitoring circuit is configured to generate an output signal indicating the open status when the capacitor voltage is higher than the threshold voltage.

5. The circuit of claim 1, further comprising a Zener diode, the Zener diode having a cathode coupled to the anode of the target circuit and having an anode coupled to the cathode of the target circuit, wherein a normal forward voltage of the target circuit is less than a clamping voltage of the Zener diode.

6. The circuit of claim 1, wherein the capacitor is configured to be discharged at a rate such that a capacitor voltage holds the switch ON for a period of time when the target circuit is bypassed.

7. The circuit of claim 6, wherein the monitoring circuit further comprises:

a first power supply input coupled to the first terminal of the capacitor; and a second power supply input coupled to the second terminal of the capacitor;

wherein the capacitor is configured to be discharged by a bias current between the first power supply input and the second power supply input.

8. The circuit of claim 1, wherein the bypass circuit further comprises:

a latch, comprising a set terminal, a reset terminal and an output, wherein the set terminal is coupled to the output of the monitoring circuit, and wherein the reset terminal is coupled to the anode of the target circuit; and a charge pump, comprising:

an input, coupled to the output of the latch;

a first power supply input, coupled to the anode of the target circuit;

a second power supply input, coupled to the cathode of the target circuit;

a first output, coupled to the control terminal of the switch; and a second output, coupled to the first terminal of the capacitor.

9. The circuit of claim 8, wherein the bypass circuit further comprises a pulse generator coupled between the latch and the charge pump, the pulse generator comprising:

an input, connected to the output of the latch; and an output, connected to the input of the charge pump;

wherein the pulse generator is configured to periodically turn OFF the switch.

10. A circuit, comprising:

a sample circuit, coupled to a target circuit, the sample circuit comprising a capacitor, wherein the capacitor has a first terminal coupled to an anode of the target circuit and wherein the capacitor has a second terminal coupled to a cathode of the target circuit;

a monitoring circuit, coupled to the capacitor and the monitoring circuit having an output configured to generate an output signal selectively indicating an open status of the target circuit; a latch, comprising a set terminal, a reset terminal and an output, wherein the set terminal is coupled to the output of the monitoring circuit, and wherein the reset terminal is coupled to the anode of the target circuit;

a charge pump, comprising an enable terminal coupled to the output of the latch and further comprising a first output; and a switch, comprising a control terminal, a first terminal and a second terminal, wherein the control terminal is coupled to the first output of the charge pump, wherein the first terminal is coupled to the anode of the target circuit, and wherein the second terminal is coupled to the cathode of the circuit.

11. The circuit of claim 10, wherein the charge pump further comprises a second output, wherein the second output is coupled to the first terminal of the capacitor, and wherein the second output is configured to maintain a capacitor voltage above a minimum voltage for a period of time.

12. The circuit of claim 10, wherein the latch comprises a first power supply input and a second power supply input, wherein the first power supply input is coupled to the first terminal of the capacitor, and wherein the second power supply input is coupled to the second terminal of the capacitor.

13. The circuit of claim 10, wherein the charge pump comprises a first power supply input and a second power supply input, wherein the first power supply input is coupled to the anode of the target circuit, and wherein the second power supply input is coupled to the cathode of the target circuit.

14. The circuit of claim 10, wherein the bypass circuit further comprises a pulse generator, wherein the pulse generator is connected between the output of the latch and the input of the charge pump, and wherein the pulse generator is configured to periodically turn OFF the switch.

15. A method for bypassing a target circuit, comprising:

coupling a switch in parallel to a target circuit;

sampling a forward voltage across the target circuit through a capacitor coupled to the target circuit; and monitoring the status of the target circuit based on the forward voltage; wherein if an open status is detected, turning ON the switch to bypass the target circuit, and holding the switch ON for a period of time based on the capacitor holding a capacitor voltage; and if a normal status is detected, keeping the switch OFF.

16. The method of claim 15, wherein the target circuit is a LED among a plurality of LEDs coupled in series.

17. The method of claim 15, wherein an open status is detected when the capacitor voltage is higher than a threshold voltage.

18. The method of claim 15, further comprising periodically turning OFF the switch to check if the open status is eliminated.

19. The method of claim 18, wherein the method of turning OFF the switch comprises:

discharging the capacitor and maintaining the capacitor voltage larger than the threshold voltage for a period of time; and turning OFF the switch if the capacitor voltage is decreased to be lower than the threshold voltage.

20. The method of claim 18, wherein the method of turning OFF the switch comprises periodically forcing the switch OFF.

* * * * *